US008797224B2

(12) United States Patent
Shinkai et al.

(10) Patent No.: US 8,797,224 B2
(45) Date of Patent: Aug. 5, 2014

(54) ARRAY ANTENNA APPARATUS INCLUDING MULTIPLE STEERABLE ANTENNAS AND CAPABLE OF ELIMINATING INFLUENCE OF SURROUNDING METAL COMPONENTS

(75) Inventors: Sotaro Shinkai, Osaka (JP); Wataru Noguchi, Hyogo (JP); Hiroyuki Yurugi, Osaka (JP); Masahiko Nagoshi, Osaka (JP); Akihiko Shiotsuki, Osaka (JP); Osamu Tanaka, Osaka (JP); Toyoshi Yamada, Osaka (JP); Nobuhiko Arashin, Osaka (JP)

(73) Assignee: Panasonic Corporation, Osaka (JP)

( * ) Notice: Subject to any disclaimer, the term of this patent is extended or adjusted under 35 U.S.C. 154(b) by 546 days.

(21) Appl. No.: 13/142,385

(22) PCT Filed: Aug. 21, 2009

(86) PCT No.: PCT/JP2009/004025

§ 371 (c)(1),
(2), (4) Date: Sep. 26, 2011

(87) PCT Pub. No.: WO2010/073429

PCT Pub. Date: Jul. 1, 2010

(65) Prior Publication Data

US 2012/0027056 A1 Feb. 2, 2012

(30) Foreign Application Priority Data

Dec. 26, 2008 (JP) ..... 2008-332425

(51) Int. Cl.
*H01Q 19/10* (2006.01)

(52) U.S. Cl.
USPC ..... 343/818

(58) Field of Classification Search
USPC ..... 343/818, 834, 836, 893
See application file for complete search history.

(56) References Cited

U.S. PATENT DOCUMENTS 6,407,719 B1 * 6/2002 Ohira et al. ..... 343/893

(Continued)

FOREIGN PATENT DOCUMENTS

| | | |
|---|---|---|
| EP | 1 808 931 | 7/2007 |
| EP | 2 088 642 | 8/2009 |
| JP | 2002-261532 | 9/2002 |
| JP | 2007-13692 | 1/2007 |

(Continued)

OTHER PUBLICATIONS

International Search Report issued Nov. 24, 2009 in International (PCT) Application No. PCT/JP2009/004025.

International Preliminary Report on Patentability issued Sep. 29, 2011 in International (PCT) Application No. PCT/JP2009/004025.

*Primary Examiner* — Seung Lee
(74) *Attorney, Agent, or Firm* — Wenderoth, Lind & Ponack, L.L.P.

(57) ABSTRACT

An antenna unit is provided with: steerable antennas, each having one active antenna element and two parasitic antenna element; and metal blocks. Each of the active antenna elements is associated with at least one of the metal blocks such that the metal block is disposed remote from the active antenna element by a predetermined distance and operates as a reflector for the active antenna element. Each of the parasitic antenna elements is provided with a switching circuit for changing an electrical length of the parasitic antenna element, and the parasitic antenna element operates as a reflector for an active antenna element of the same steerable antenna as the parasitic antenna element by changing the electrical length using the switching circuit.

12 Claims, 7 Drawing Sheets

(56) References Cited

U.S. PATENT DOCUMENTS

| | | | | |
|---|---|---|---|---|
| 7,499,001 | B2 | 3/2009 | Fujieda | |
| 7,656,360 | B2 * | 2/2010 | Hirabayashi | 343/818 |
| 8,098,199 | B2 * | 1/2012 | Shinkai et al. | 342/374 |
| 2006/0232492 | A1 * | 10/2006 | Sawatani | 343/893 |
| 2007/0001924 | A1 | 1/2007 | Hirabayashi | |
| 2008/0036675 | A1 | 2/2008 | Fujieda | |
| 2008/0278405 | A1 * | 11/2008 | Montgomery et al. | 343/893 |
| 2009/0046019 | A1 | 2/2009 | Sato | |
| 2010/0231451 | A1 | 9/2010 | Noguchi et al. | |

FOREIGN PATENT DOCUMENTS

| | | |
|---|---|---|
| JP | 2008-72701 | 3/2008 |
| JP | 2008-109214 | 5/2008 |
| WO | 2006/038432 | 4/2006 |
| WO | 2006/049002 | 5/2006 |
| WO | 2008/050758 | 5/2008 |

* cited by examiner

ARRAY ANTENNA APPARATUS INCLUDING MULTIPLE STEERABLE ANTENNAS AND CAPABLE OF ELIMINATING INFLUENCE OF SURROUNDING METAL COMPONENTS

TECHNICAL FIELD

The present invention relates to an array antenna apparatus including a plurality of steerable antennas each capable of electrically changing its main radiation direction, and more particularly, relates to an array antenna apparatus capable of simultaneously feeding two or more steerable antennas.

BACKGROUND ART

Wireless appliances, such as wireless LANs complying with IEEE802.11a/b/g standards, and Bluetooth, have been proliferated in recent years. IEEE 802.11a and IEEE 802.11g specified the data transmission rate of 54 Mbps, and recently, active researches and developments have been done on wireless schemes for achieving higher transmission rates.

As one of techniques for increasing transmission rates of wireless communication systems, a MIMO (Multi-Input Multi-Output) communication system has received wide attention. This is a technique for increasing transmission capacity and improving communication speed by providing each of a transmitter and a receiver with multiple antenna elements and having transmission paths spatially multiplexed. This technique is essential not only for wireless LANs, but also for next-generation wireless communication systems such as mobile phone communication systems and IEEE 802.16e (WiMAX).

According to the MIMO communication scheme, the transmitter divides and sends transmitting data through the multiple active antenna elements, the data is transmitted over multiple virtual MIMO channels, and the receiver receives signals through the multiple antenna elements and processes the signals to obtain received data. In general, a wireless communication apparatus using the MIMO communication scheme is provided with multiple omnidirectional active antenna elements such as dipole antennas or sleeve antennas. In this case, there is a problem of degradation in transmission quality caused by increases in the correlations between active antenna elements, unless addressing this situation by, e.g., sufficiently separating the antenna elements from one another, or tilting the respective antenna elements in different directions to make a combination of different polarizations.

Among prior arts available for solving the above problem, for example, an array antenna apparatus disclosed in Patent Literature 1, which is an adaptive directional antenna, may be used. The array antenna apparatus disclosed in Patent Literature 1 is configured such that a half-wave dipole antenna is mounted perpendicularly on a dielectric support substrate, and three printed wiring boards are disposed to surround the half-wave dipole antenna. The half-wave dipole antenna is supplied with a radio frequency signal through a balanced feeder cable. Moreover, on the back side of each printed wiring board, two sets of passive antenna elements (parasitic elements) are disposed in parallel with each other, each set including two printed antenna elements (elements each made of a conductor pattern). In each parasitic element, the two printed antenna elements oppose to each other with a space therebetween. A through-hole conductor is provided at one end of each printed antenna element opposing to the other printed antenna element, and is connected to an electrode terminal on the front side of the printed wiring board. In each parasitic element, a variable-capacitance diode is mounted between the two electrode terminals, these electrode terminals are further connected to a pair of cables through high value resistors for blocking radio frequencies, and the pair of cables are connected to bias voltage supply terminals DC+ and DC− of a controller (not shown) for controlling to steer the array antenna apparatus. By changing bias voltages supplied from the controller, the respective reactance values of the variable-capacitance diodes connected to the parasitic elements change. In this manner, the electrical length of each parasitic element is changed as compared to that of the half-wave dipole antenna, thus changing the horizontal radiation pattern of the array antenna apparatus.

Moreover, an antenna apparatus disclosed in Patent Literature 2 is configured to include: a linear radiating element disposed on a first surface; a first parasitic element disposed on the first surface and parallel to the radiating element; a first grounding conductor disposed on the first surface; first switches for connecting both ends of the first parasitic element to the first grounding conductor; a second grounding conductor disposed on a second surface opposite to the first surface; and control means for controlling the close and open of the switches. A part of the first grounding conductor is disposed parallel to the radiating element, and opposite to the first parasitic element with respect to the radiating element and. The second grounding conductor is opposed to the radiating element, and an edge of the second grounding conductor is opposed to a region between the radiating element and the first parasitic element. According to the antenna apparatus of this invention and a wireless terminal using the antenna apparatus, the antenna directivity can be changed between back and zenith directions by closing or opening the switches. Thus, even when the wireless terminal has different usage modes, such as a voice call mode and a data communication mode, it is possible to perform high-quality communication by changing the antenna directivity to the one suitable for a particular usage mode.

In the case of performing MIMO communication, it is possible to use an array antenna apparatus including a plurality of steerable antennas disclosed in Patent Literature 1 or 2, and thus, to set each steerable antenna's radiation pattern so as to reduce the correlations among active antenna elements.

CITATION LIST

Patent Literature

PATENT LITERATURE 1: Japanese Patent Laid-open Publication No. 2002-261532.

PATENT LITERATURE 2: PCT International Publication WO2006/038432.

SUMMARY OF INVENTION

Technical Problem

It is possible to reduce the correlations among active antenna elements by using steerable antennas disclosed in Patent Literature 1 or 2 for MIMO communication. However, in the case in which the above-described conventional steerable antennas are provided within a wireless communication apparatus covered with metal, there is such a problem that the a metal portions of a housing around the antennas, or metal components of the wireless communication apparatus may interfere with the antenna steering, thus degrading antenna qualities.

An object of the present invention is to solve the aforementioned conventional problem, and to provide a steerable array antenna apparatus suitable for a MIMO communication scheme, without interfering with the antenna steering due to a metal housing and metal components of a wireless communication apparatus on which the array antenna apparatus is mounted.

Solution to Problem

According to an aspect of the present invention, there is provided an array antenna apparatus, the array antenna apparatus is provided with: a plurality of steerable antennas, each having one active antenna element and at least one parasitic antenna element; and at least one metal block with a length longer than a longitudinal length of each of the active antenna elements. At least two of the steerable antennas are simultaneously excited. Each of the active antenna elements is associated with at least one of the at least one metal block such that the metal block is disposed remote from the active antenna element by a predetermined distance and operates as a reflector for the active antenna element. Each of the parasitic antenna elements is provided with a switching circuit for changing an electrical length of the parasitic antenna element, and the parasitic antenna element operates as a reflector for an active antenna element of the same steerable antenna as the parasitic antenna element by changing the electrical length using the switching circuit.

The array antenna apparatus is provided with one metal block, and the one metal block is disposed remote from each of the active antenna elements by a predetermined distance and operates as a reflector for each of the active antenna elements.

In the array antenna apparatus, each of the active antenna elements is associated with one metal block such that each metal block is disposed remote from the corresponding active antenna element by a predetermined distance and operates as a reflector for the corresponding active antenna element.

In the array antenna apparatus, the plurality of steerable antennas are provided on two opposite surfaces of a dielectric block, and each metal block is provided so as to pass through the dielectric block.

In the array antenna apparatus, each of the parasitic antenna elements is a half-wave dipole antenna, and each of the switching circuits is a PIN diode connected in series at a center of a corresponding parasitic antenna element.

In the array antenna apparatus, each of the parasitic antenna elements is a half-wave dipole antenna, and each of the switching circuits is a variable-capacitance diode connected in series at a center of a corresponding parasitic antenna element.

In the array antenna apparatus, each of the active antenna elements and the parasitic antenna elements is formed as a conductor patterned on a dielectric substrate.

In the array antenna apparatus, each of the active antenna elements and the parasitic antenna elements is a monopole element which is a conductor element with a length of one-quarter wavelength and perpendicular to a ground conductor, and each of the switching circuits is a PIN diode connected between a conductor element of a corresponding parasitic antenna element and the ground conductor.

In the array antenna apparatus, each of the active antenna elements and the parasitic antenna elements is a monopole element which is a conductor element with a length of one-quarter wavelength and perpendicular to a ground conductor, and each of the switching circuits is a variable-capacitance diode connected between a conductor element of a corresponding parasitic antenna element and the ground conductor.

In the array antenna apparatus, each of the active antenna elements is a dipole antenna.

In the array antenna apparatus, each of the active antenna elements is a sleeve antenna.

The array antenna apparatus transmits and receives a plurality of radio signals in accordance with a MIMO communication scheme.

Advantageous Effects of Invention

According to an array antenna apparatus of the present invention, each metal block is located at the position remote from the steerable antennas by the predetermined distances, and operates as the reflector for the active antenna elements on the steerable antennas. Since the antenna substrates including the steerable antennas are disposed along the outer surface of the wireless communication apparatus, the main radiation directions of the steerable antennas are always outward from the wireless communication apparatus.

In addition, each steerable antenna includes at least one parasitic antenna element, and a switching circuit is connected to each parasitic antenna element for changing its electrical lengths. Each switching circuit includes a PIN diode or a variable reactance element. By applying an appropriate voltage to a switching circuit, a corresponding parasitic antenna element operates as a reflector.

According to the above configuration, since both the metal block and the parasitic antenna element operate as reflectors, it is possible to change the main radiation direction of the steerable antenna on the azimuth plane, as well as maintain the outward radiation direction from the wireless communication apparatus. Accordingly, even when a metal housing or metal components of the wireless communication apparatus are located near the array antenna apparatus within the wireless communication apparatus, it is possible to change the radiation pattern without degrading the gain due to the influence of the metal housing or the metal components.

In addition, due to the metal block(s), the respective main radiation directions of the steerable antennas are different from each other. Accordingly, the correlations among antenna elements decreases, thus obtaining good performance in MIMO communication.

Further, it is possible to achieve stable communication by controlling the parasitic antenna elements so as to obtain an optimal combination of the respective radiation patterns of the steerable antennas.

DESCRIPTION OF EMBODIMENTS

Figure 1:
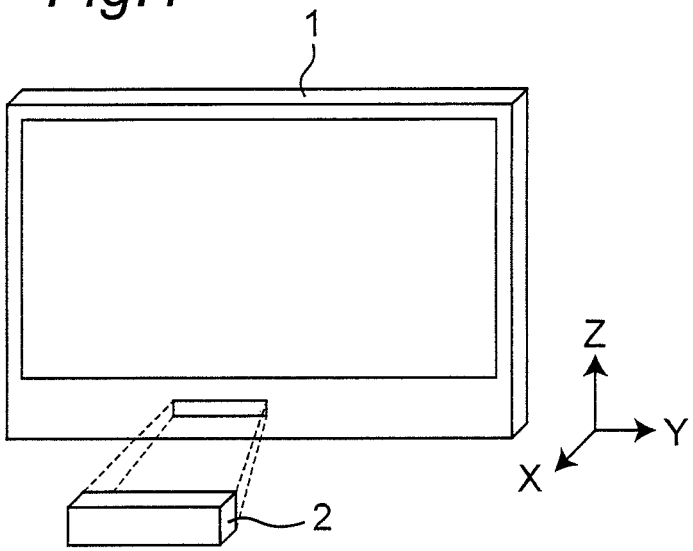
FIG. 1 is an overall view showing a wireless communication apparatus 1 provided with an antenna unit 2 according to a first embodiment of the present invention.

Preferred embodiments of the present invention will be described below with reference to the drawings. The same reference numerals are used for similar components throughout the specification and the drawings, and those components are not explained repeatedly. In addition, XYZ coordinates in each drawing are referred to.

First Embodiment

Figure 2:
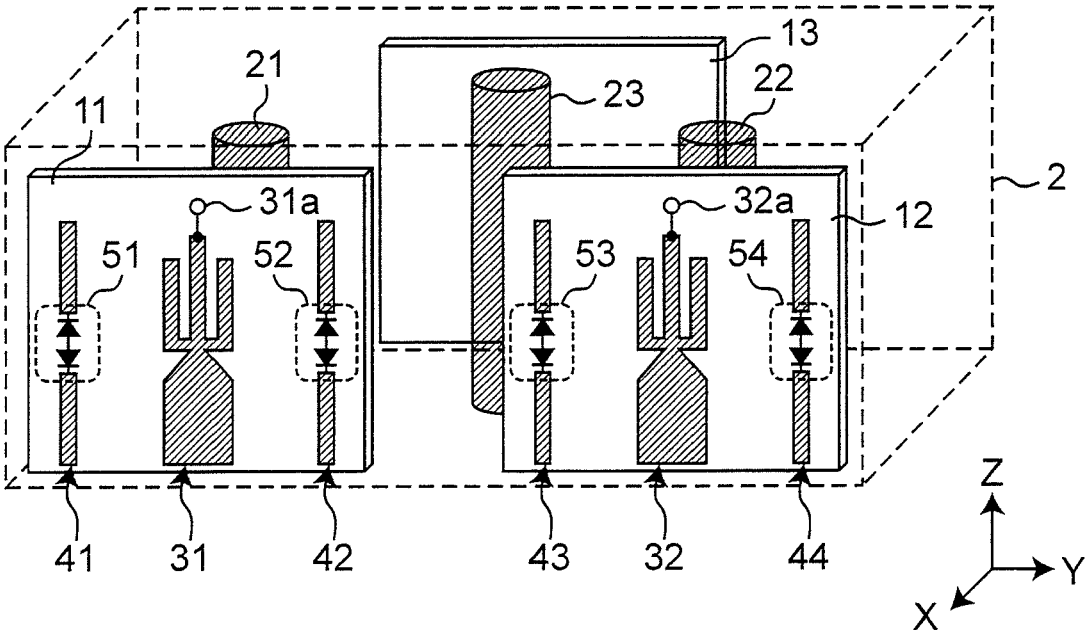
FIG. 2 is a perspective view showing a detailed configuration of the antenna unit 2 of FIG. 1.
Figure 3:
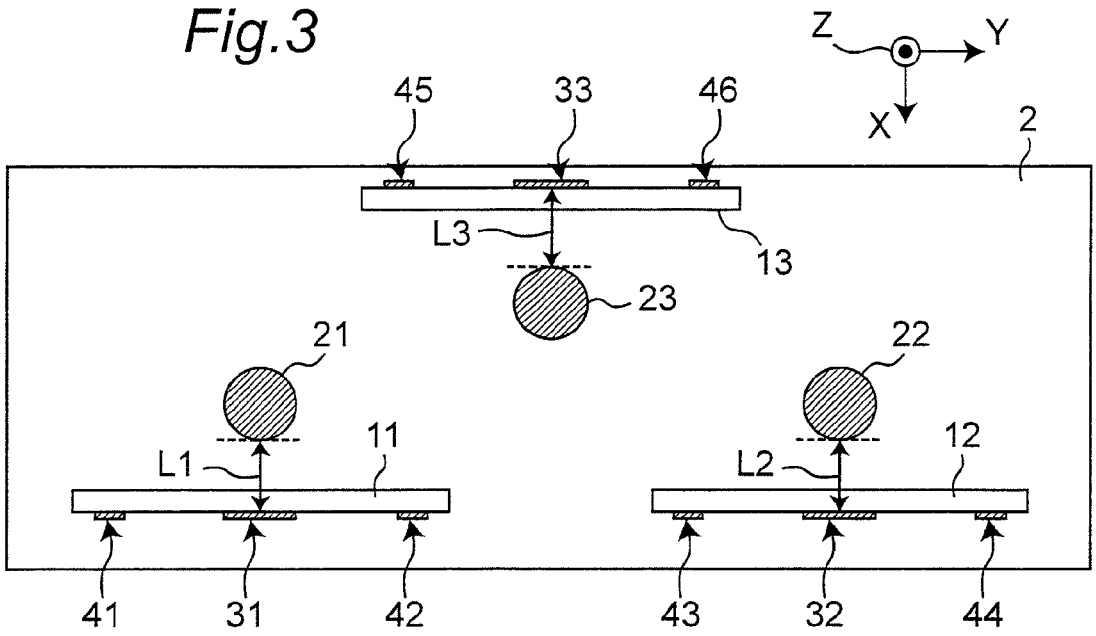
FIG. 3 is a top view showing a detailed configuration of the antenna unit 2 of FIG. 1.

FIG. 1 is an overall view showing a wireless communication apparatus 1 provided with an antenna unit 2 according to a first embodiment of the present invention. FIG. 2 is a perspective view showing a detailed configuration of the antenna unit 2 of FIG. 1. FIG. 3 is a top view showing a detailed configuration of the antenna unit 2 of FIG. 1.

The wireless communication apparatus 1 is a television apparatus as shown in FIG. 1, a player (e.g., a DVD player), or the like, and is configured to include a metal housing. A part of the metal housing is removed, and the wireless communication apparatus 1 is provided with the antenna unit 2 including a plurality of steerable antennas. The antenna unit 2 is used to perform at least one of transmission and reception of, for example, but not limited thereto, radio frequency signals in the 5 GHz band. The antenna unit 2 of the present embodiment is provided with antenna substrates 11, 12, and 13 respectively including active antenna elements 31, 32, and 33 configured to be steerable, and metal blocks 21, 22, and 23 respectively disposed close to the active antenna elements 31, 32, and 33 of the respective antenna substrates 11, 12, and 13, as shown in FIGS. 2 and 3. The antenna substrates 11 and 12 are disposed on an +X surface of the antenna unit 2 which is substantially rectangular parallelepiped, and the antenna substrate 13 is disposed on a −X surface of the antenna unit 2. The antenna substrate 11 is configured to include the active antenna element 31 patterned on a dielectric printed wiring board as a sleeve antenna, and two parasitic antenna elements 41 and 42 patterned on the dielectric printed wiring board as half-wave dipole antennas. The active antenna element 31 and the parasitic antenna elements 41 and 42 are disposed in parallel to the Z axis. A feeding point 31*a* is provided at one end of the active antenna element 31 as a radio frequency connector, and the feeding point 31*a* is connected to a wireless communication circuit such as a MIMO modulator and demodulator circuit 200 of FIG. 12, thus transmitting and receiving radio signals through the active antenna element 31. The parasitic antenna elements 41 and 42 are respectively provided with switching circuits 51 and 52 for adjusting their electrical lengths. The antenna substrate 12 is also similarly configured to include the active antenna element 32 with a feeding point 32*a*, and parasitic antenna elements 43 and 44 with switching circuits 53 and 54. The antenna substrate 13 is also similarly configured to include the active antenna element 33 with a feeding point, and parasitic antenna elements 45 and 46 with switching circuits 55 and 56.

Figure 12:
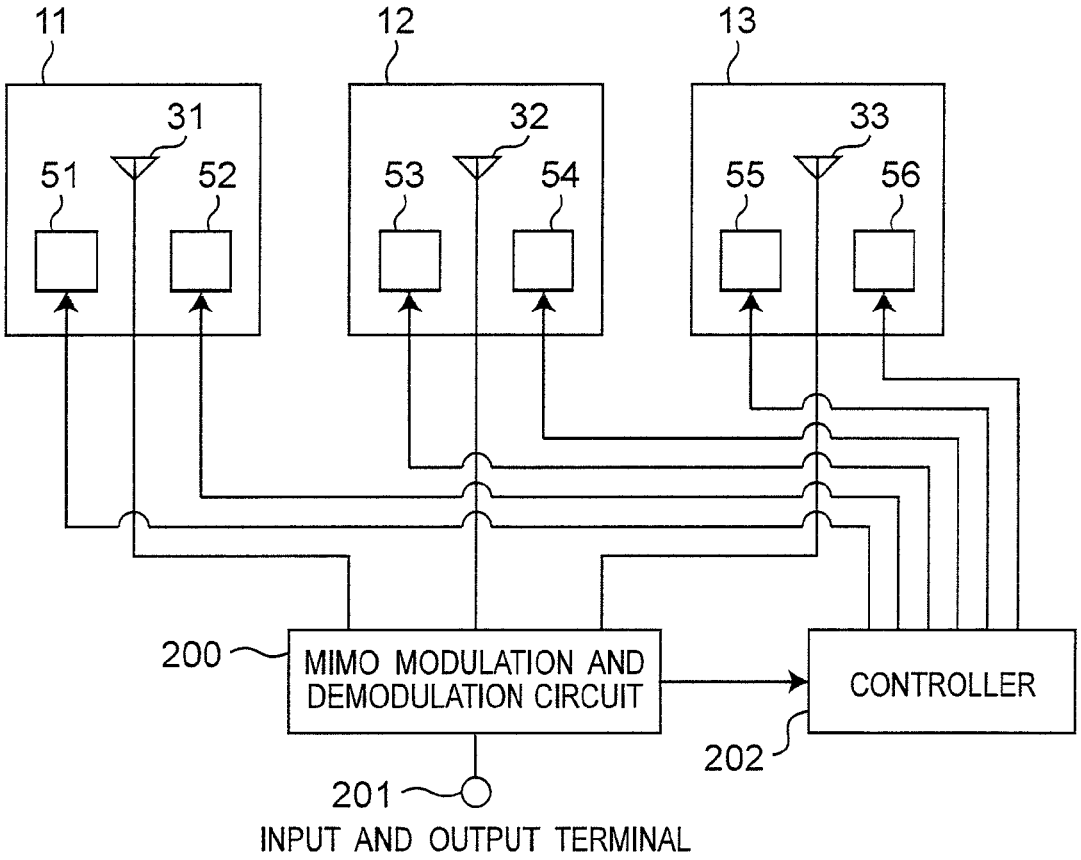
FIG. 12 is a circuit diagram showing a MIMO wireless communication circuit including the antenna unit 2 according to the first embodiment of the present invention.

FIG. 12 is a circuit diagram showing a MIMO wireless communication circuit including the antenna unit 2 according to the first embodiment of the present invention. In FIG. 12, the parasitic antenna elements 41, 42, 43, 44, 45, and 46, etc., are not shown for ease of illustration. The active antenna elements 31, 32, and 33 are connected to the MIMO modulator and demodulator circuit 200. Upon reception, the MIMO modulator and demodulator circuit 200 recovers original data streams from radio signals received by the active antenna elements 31, 32, and 33, to output the data streams to an input and output terminal 201, and computes and sends signal qualities of the received radio signals to a controller 202. In addition, upon transmission, the MIMO modulator and demodulator circuit 200 divides and modulates a data stream inputted from the input and output terminal 201 and passes the modulated radio signals to the active antenna elements 31, 32, and 33, respectively. The MIMO modulator and demodulator circuit 200 simultaneously excites at least two of three (or more) steerable antennas using a MIMO communication scheme. The controller 202 changes the radiation patterns of the active antenna elements 31, 32, and 33 by changing control voltages to the switching circuits 51, 52, 53, 54, 55, and 56 (described below in detail).

Now, the detailed configuration and operation of the steerable antennas will be explained. On the antenna substrate 11, the parasitic antenna elements 41 and 42 are disposed on lines parallel to and remote from a line, on which the active antenna element 31 is located, by a distance of one-quarter of an operating wavelength for communication, such that the active antenna element 31 are disposed between the parasitic antenna elements 41 and 42. In this case, the distance of one-quarter of the operating wavelength changes dependent on the permittivity of a dielectric printed wiring board to be used, and the higher the permittivity the shorter the distance. Each of the parasitic antenna elements 41 and 42 is made of two strip parasitic conductor elements. Two parasitic conductor elements of the parasitic antenna element 41 are opposed to each other with a space therebetween, and located along a straight line. The switching circuit 51 is provided at opposing ends of the two parasitic conductor elements. Similarly, two parasitic conductor elements of the parasitic antenna element 42 are opposed to each other with a space therebetween, and located along a straight line. The switching circuit 52 is provided at opposing ends of the two parasitic conductor elements.

Figure 4:
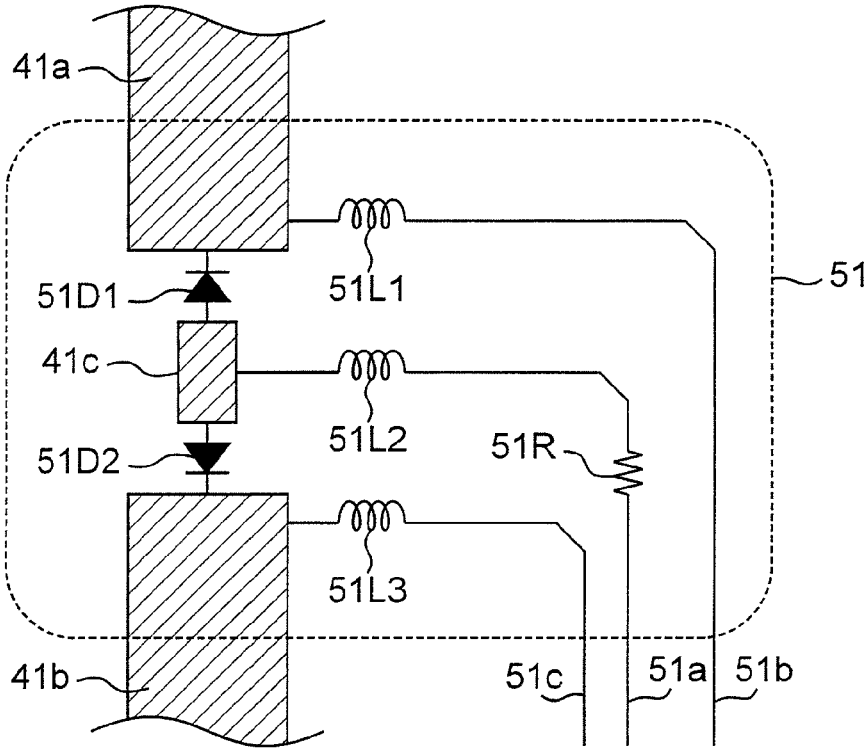
FIG. 4 is a circuit diagram showing a detailed configuration of a switching circuit 51 of FIG. 2.

FIG. 4 is a circuit diagram showing a detailed configuration of the switching circuit 51 of FIG. 2. FIG. 4 shows an enlargement including the opposing ends of the two parasitic conductor elements 41*a* and 41*b* of the parasitic antenna element 41, and including the switching circuit 51 between the opposing ends. A pair of PIN diodes 51D1 and 51D2 is provided on the opposing ends of the parasitic conductor elements 41*a* and 41*b*. A cathode terminal of the PIN diode 51D1 is connected to the parasitic conductor element 41*a*, a cathode terminal of the PIN diode 51D2 is connected to the parasitic conductor element 41*b*, and respective anode terminals of the PIN diodes 51D1 and 51D2 are connected to each other through a conductor portion 41*c*. The anode terminals of the PIN diodes 51D1 and 51D2 are connected to a bias voltage supply terminal (DC terminal) of the controller 202 through the conductor portion 41*c* and a control line 51*a*, and the controller 202 controls the radiation pattern of the active antenna element 31 by applying a control voltage (i.e., a bias voltage). The cathode terminals of the PIN diodes 51D1 and 51D2 are respectively connected, through control lines 51*b* and 51*c*, to a ground terminal (GND terminal) of the controller 202. Accordingly, the control lines 51*a*, 51*b*, and 51*c* are respectively a direct-current voltage supply line and GND lines for controlling the parasitic antenna element 41. On the control line 51*a*, a radio frequency choke inductor (coil) 51L2 having, for example, an inductance of about several tens of nH is provided so as to be close to the anode terminals of the PIN diodes 51D1 and 51D2. Further, on the control line 51*a*, a current control resistor 51R of about several kilo-ohms is provided. In addition, on the control lines 51*b* and 51*c*, radio frequency choke inductors 51L1 and 51L3 each having, for example, an inductance of about several tens of nH are respectively provided so as to be close to the cathode terminals of the PIN diodes 51D1 and 51D2. The inductors 51L1, 51L2, and 51L3 serve to prevent a radio frequency signal excited at the parasitic antenna element 41 from leaking onto the control lines 51*a*, 51*b*, and 51*c*, respectively. The parasitic antenna element 42 is also configured in a manner similar to that of the parasitic antenna element 41, and the other antenna substrates 12 and 13 are also configured in a manner similar to that of the antenna substrate 11.

Next, the operation of the antenna unit 2 of the present embodiment will be explained.

As described above, on each of the antenna substrates 11, 12, and 13, two parasitic antenna elements are disposed at positions remote from an active antenna element by a distance of one-quarter of an operating wavelength for communication. As shown in FIG. 3, the metal blocks 21, 22, and 23 are disposed within the antenna unit 2 so as to be respectively parallel to the active antenna elements 31, 32, and 33, and respectively remote from the active antenna elements 31, 32, and 33 by a distance L1=L2=L3 equal to one-quarter of the operating wavelength for communication. The metal blocks 21, 22, and 23 are, for example, cylindrical. If the operating frequency for communication is, for example, 5 GHz, then the metal blocks 21, 22, and 23 are formed as, for example, a cylinder with a diameter of about 5 mm. In addition, the metal blocks 21, 22, and 23 has a height of about one-half of the operating wavelength for communication, according to the present embodiment, and the height is preferably larger than the longitudinal length of the active antenna elements 31, 32, and 33 by 5 to 10% thereof.

In the antenna unit 2 having the above-described configuration, the metal block 21 is excited by a radio wave radiated from the active antenna element 31, and re-radiates the radio wave. Since the distance L1 between the active antenna element 31 and the metal block 21 is one-quarter of the operating wavelength, the radio wave re-radiated from the metal block 21 is delayed in phase by 90 degrees with respect to the radio wave radiated from the active antenna element 31. As a result of superposition of these two radio waves, radio waves propagating in a −X direction relative to the metal block 21, i.e., an inward direction of the antenna unit 2 (i.e., an inward direction of the wireless communication apparatus 1), are cancelled, and radio waves propagating in a +X direction relative to the active antenna element 31, i.e., an outward direction of the wireless communication apparatus 1, are strengthened.

Further, when a control voltage from the controller 202 is off, no voltage is applied to the PIN diodes of the switching circuits 51 and 52, and thus, the parasitic antenna elements 41 and 42 are not excited and do not affect the radiation pattern of the active antenna element 31. Hence, the main radiation direction of the active antenna element 31 is in the +X direction. On the other hand, in the case in which the controller 202 turns on a control voltage to, for example, the parasitic antenna element 41, the controller 202 applies a bias voltage from the DC terminal to the anodes of the PIN diodes 51D1 and 51D2 through the control line 51*a* such that the applied bias voltages are higher than an operating voltage of the PIN diodes 51D1 and 51D2 (e.g., about 0.8 V), and thus, the PIN diodes 51D1 and 51D2 become conductive. At this time, the parasitic antenna element 41 is excited by a radio wave radiated from the active antenna element 31, and re-radiates the radio wave. Since the space between the active antenna element 31 and the parasitic antenna element 41 is one-quarter of the operating wavelength, the radio wave re-radiated from the parasitic antenna element 41 is delayed in phase by 90 degrees with respect to the radio wave radiated from the active antenna element 31. As a result of superposition of these two radio waves, radio waves propagating in a −Y direction relative to the parasitic antenna element 41 are cancelled, and radio waves propagating in a +Y direction relative to the active antenna element 31 are strengthened. At this time, since radio waves in the +X direction are strengthened by the metal block 21, the resultant main radiation direction of the active antenna element 31 is in the "+X+Y" direction.

Also in the case of turning the other parasitic antenna elements 42, 43, 44, 45, and 46 on, the radiation patterns of the active antenna elements 31, 32, and 33 can be similarly controlled. For example, in the case of turning the parasitic antenna element 42 on, the main radiation direction of the active antenna element 31 is in the "+X−Y" direction. In the case of simultaneously turning the parasitic antenna elements 41 and 42 on, the main radiation direction of the active antenna element 31 is in the +X direction. Although the main radiation direction of the active antenna element 31 is in the +X direction even when turning the parasitic antenna elements 41 and 42 off, the higher gain in the main radiation direction is obtained when turning the parasitic antenna elements 41 and 42 on.

Figure 13:
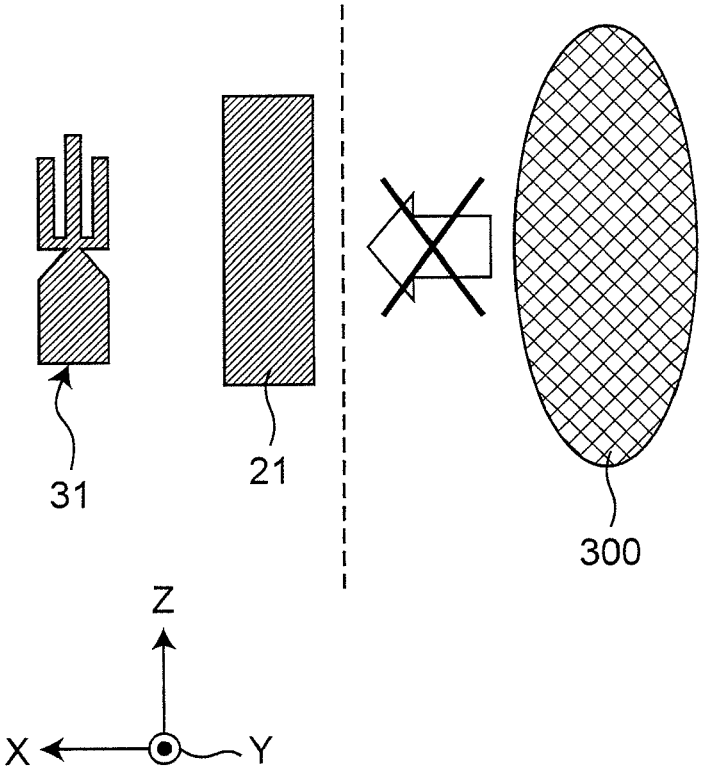
FIG. 13 is a schematic diagram showing an effect of a metal block 21 in the antenna unit 2 according to the first embodiment of the present invention.

That is, each of the active antenna elements 31, 32, and 33 can select one of four radiation patterns by switching parasitic antenna elements. In this case, if there are no metal blocks 21, 22, and 23, metal components within the wireless communication apparatus 1 produce complex reflections, and radio waves cancel each other, thus preventing proper changes of radiation patterns. On the other hand, even when metal components are scattered around the antenna unit 2 or in the antenna unit 2 (i.e., around the active antenna elements or the parasitic antenna elements), it is possible to reduce their influence and properly change radiation patterns by providing the metal blocks 21, 22, and 23. FIG. 13 is a schematic diagram showing an effect of the metal block 21 in the antenna unit 2 according to the first embodiment of the present invention. In this diagram, metal components etc., of the wireless communication apparatus 1 are schematically denoted by reference numeral 300. As shown in FIG. 13, by providing the metal block 21 for the active antenna element 31, it is possible to eliminate the influence of the metal components etc. 300 located on the −X side of the metal block 21.

In addition, in the case of MIMO communication, when antenna elements come close to each other, the correlations among the antenna elements increases, thus decreasing communication performance. On the other hand, in the antenna unit 2 according to the present embodiment of the present invention, the respective main radiation directions of the three active antenna elements 31, 32, and 33 are different from each other, and accordingly, even when the three active antenna elements 31, 32, and 33 are provided close to one another, it is less likely to cause degradation in communication performance, and it is effective in reducing size of the antenna unit 2.

Modified Embodiment

Although the present embodiment shows the case in which sleeve antennas are used as the active antenna elements 31, 32, and 33, any antennas can be used as long as the antennas have radiation patterns on the horizontal plane (XY plane) which is nearly omnidirectional. Accordingly, it is possible to implement an antenna unit 2 operable in a manner similar to that of the present embodiment, even when using dipole antennas, collinear antennas, monopole antennas, or inverted-F antennas. In addition, although the present embodiment shows an example in which three active antenna elements 31, 32, and 33 and six parasitic antenna elements 41, 42, 43, 44, 45, and 46 are disposed, the numbers of the respective elements may be increased or decreased. Similarly, the number of the antenna substrates 11, 12, and 13 may be increased or decreased. In addition, although the present embodiment shows the case in which PIN diodes are used in a switching circuit, any other configuration can be employed as long as the parasitic antenna elements 41, 42, 43, 44, 45, and 46 can operate as reflectors, and for example, variable-capacitance diodes and the like may be used. Although it is desirable that the length of the metal blocks 21, 22, and 23 be larger than the longitudinal length of the active antenna elements 31, 32, and 33 by 5 to 10%, any other configuration can be employed as long as the metal blocks 21, 22, and 23 operate as reflectors. For example, it is possible to implement a configuration in which the metal blocks 21, 22, and 23 pass through the antenna unit 2 from its bottom surface to its top surface. In addition, although the present implementation example is described with reference to the cylindrical metal blocks 21, 22, and 23, the metal blocks 21, 22, and 23 may be prismatic, screw-shaped, or planar. In addition, the antenna unit 2 may be preferably filled with dielectric material, such as a resin.

As described above, according to the antenna unit 2 of the present embodiment, the metal blocks 21, 22, and 23 are disposed close to the active antenna elements 31, 32, and 33 configured to be steerable, and thus, even when a metal housing or metal components are located near or within the antenna unit in the wireless communication apparatus 1, it is possible to change radiation patterns without degrading the gain due to the influence of the metal housing or the metal components. In addition, the active antenna elements 31, 32, and 33 have the different main radiation directions due to the metal blocks 21, 22, and 23. Accordingly, the correlations among the active antenna elements 31, 32, and 33 decreases, thus obtaining good performance in MIMO communication.

Second Embodiment

Figure 5:
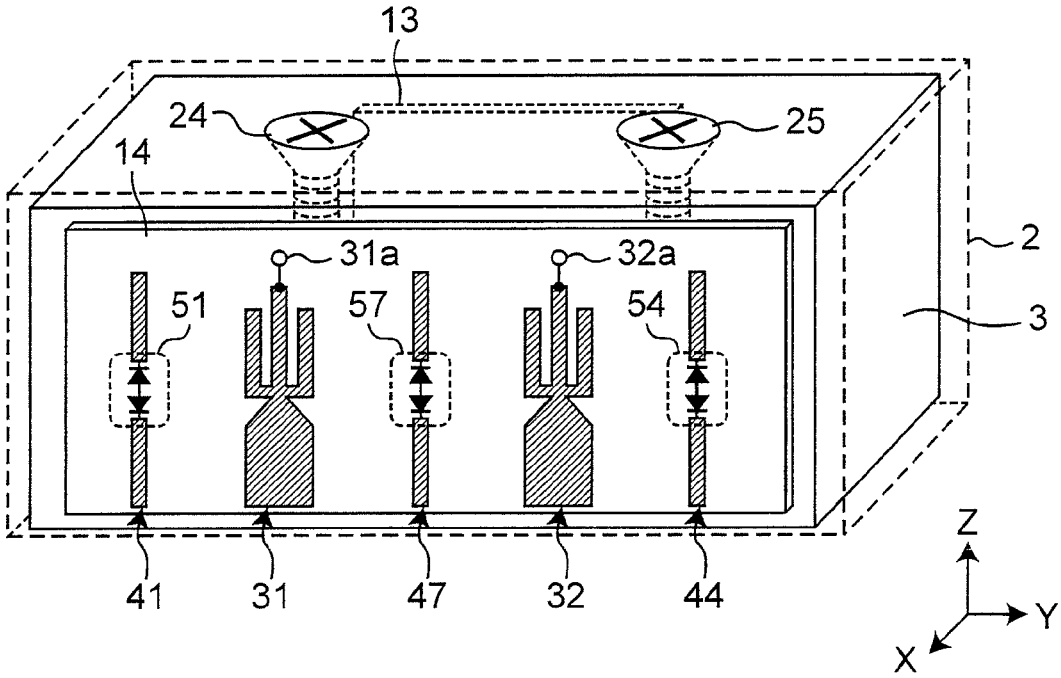
FIG. 5 is a perspective view showing an antenna unit 2 according to a second embodiment of the present invention.
Figure 6:
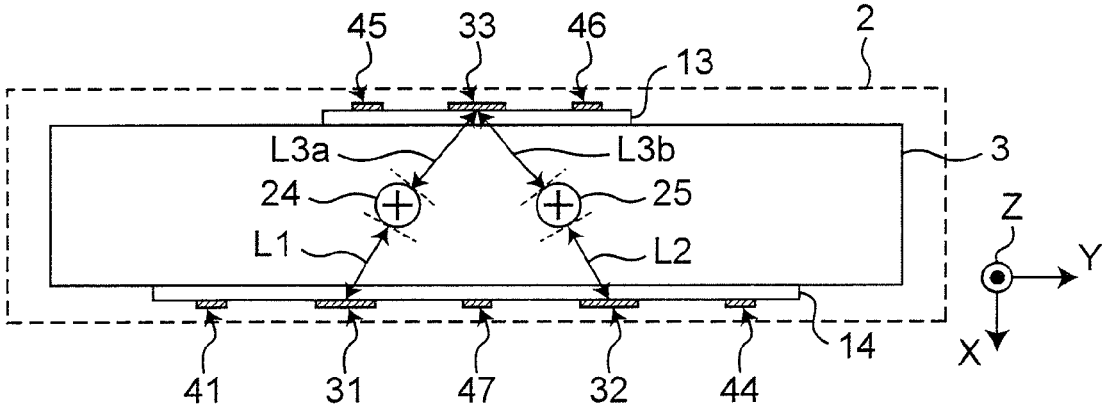
FIG. 6 is a top view of the antenna unit 2 of FIG. 5.

FIG. 5 is a perspective view showing an antenna unit 2 according to a second embodiment of the present invention. FIG. 6 is a top view of the antenna unit 2 of FIG. 5. According to embodiments of the present invention, the configuration is not limited to one in which every active antenna elements 31, 32, and 33 is provided with the corresponding one of the metal blocks 21, 22, and 23 as shown in the first embodiment, and one metal block may be shared among two or more active antenna elements. The second embodiment of the present invention is characterized by having only two metal blocks 24 and 25 that operate as reflectors for active antenna elements 31, 32, and 33.

The inside of the antenna unit 2 according to the present embodiment is filled with dielectric material, such as a resin, thus configuring a dielectric block 3. The screw-shaped metal blocks 24 and 25 are disposed so as to pass through the dielectric block 3 from its +Z surface to its −Z surface. By using the metal blocks 24 and 25 as screws, the antenna unit 2 is fixed to a housing of a wireless communication apparatus 1. The metal block 24 operates as a reflector for the active antenna element 31, the metal block 25 operates as a reflector for the active antenna element 32, and the metal blocks 24 and 25 further operate as reflectors for the active antenna element 33. Further, the antenna unit 2 of the present embodiment is provided with an antenna substrate 14 on a +X surface, and the antenna substrate 14 is an integrated version of antenna substrates 11 and 12 of FIGS. 2 and 3. The antenna substrate 14 is provided with, instead of parasitic antenna elements 42 and 43 of FIGS. 2 and 3, a parasitic antenna element 47 which is parallel to and remote from the respective active antenna elements 31 and 32 by a distance of one-quarter of an operating wavelength. The parasitic antenna element 47 is provided with a switching circuit 57 which is the same as a switching circuit 51, etc.

As in a manner similar to that of the first embodiment, a parasitic antenna element 41 and the parasitic antenna element 47 are disposed at positions remote from the active antenna element 31 by a distance of one-quarter of an operating wavelength for communication. A parasitic antenna element 44 and the parasitic antenna element 47 are disposed at positions remote from the active antenna element 32 by a distance of one-quarter of the operating wavelength for communication. Parasitic antenna elements 45 and 46 are disposed at positions remote from the active antenna element 33 by a distance of one-quarter of the operating wavelength for communication. As shown in FIG. 5, the metal blocks 24 and 25 are disposed such that the metal blocks 24 and 25 are parallel to the active antenna elements 31, 32, and 33, the metal block 24 is remote from the active antenna element 31 by a distance L1 equal to one-quarter of the operating wavelength for communication, the metal block 25 is remote from the active antenna element 32 by a distance L2 equal to one-quarter of the operating wavelength for communication, and further, the metal blocks 24 and 25 are remote from the active antenna element 33 by a distance L3*a*=L3*b* equal to one-quarter of the operating wavelength for communication.

In the antenna unit 2 with the above described configuration, the metal block 24 is excited by a radio wave radiated from the active antenna element 31, and re-radiates the radio wave. Since the distance L1 between the active antenna element 31 and the metal block 24 is one-quarter of the operating wavelength, radio waves propagating in the −X direction relative to the metal block 24, i.e., an inward direction of the antenna unit 2 (i.e., an inward direction of the wireless communication apparatus 1), are cancelled, and radio waves propagating substantially in the +X direction relative to the active antenna element 31, i.e., an outward direction of the wireless communication apparatus 1, are strengthened.

Further, when a control voltage from a controller 202 is off, no voltage is applied to PIN diodes of a switching circuit 51 and the switching circuit 57, and thus, the parasitic antenna elements 41 and 47 are not excited and do not affect the radiation pattern of the active antenna element 31. Hence, the main radiation direction of the active antenna element 31 is substantially in the +X direction. On the other hand, in the case in which the controller 202 turns on a control voltage to, for example, the parasitic antenna element 41, the controller 202 applies a bias voltage from a DC terminal to the anodes of a pair of PIN diodes through a control line such that the applied voltage is higher than an operating voltage of the PIN diodes (e.g., about 0.8 V), and thus, the PIN diodes becomes conductive. At this time, the parasitic antenna element 41 is excited by a radio wave radiated from the active antenna element 31, and re-radiates the radio wave. Since the space between the active antenna element 31 and the parasitic antenna element 41 is one-quarter of the operating wavelength, radio waves propagating in a −Y direction relative to the parasitic antenna element 41 are cancelled, and radio waves propagating in a +Y direction relative to the active antenna element 31 are strengthened. At this time, since radio waves in the +X direction are strengthened by the metal block 24, the resultant main radiation direction of the active antenna element 31 is in the "+X+Y" direction.

Also in the case of turning the other parasitic antenna elements 44, 45, 46, and 47 on, the radiation patterns of the active antenna elements 31, 32, and 33 can be similarly controlled. For example, in the case of turning the parasitic antenna element 47 on, the main radiation direction of the active antenna element 31 is in the "+X−Y" direction. In the case of simultaneously the parasitic antenna elements 41 and 47 on, the main radiation direction of the active antenna element 31 is substantially in the +X direction. In the present embodiment, the distance between the active antenna element 32 and the parasitic antenna element 47 is also configured to be one-quarter of the operating wavelength as described above, and accordingly, the parasitic antenna element 47 also operates as a reflector for the active antenna element 32.

That is, each of the active antenna elements 31, 32, and 33 can select one of four radiation patterns by switching parasitic antenna elements. In this case, if there are no metal blocks 24 and 25, metal components within the wireless communication apparatus 1 produce complex reflections, and radio waves cancel each other, thus preventing proper changes of radiation patterns. On the other hand, even when metal components are scattered around the antenna unit 2 or in the antenna unit 2 (i.e., around the active antenna elements or the parasitic antenna elements), it is possible to reduce their influence and properly change radiation patterns by providing the metal blocks 24 and 25.

In addition, in the case of MIMO communication, when antenna elements come close to each other, the correlations among the antenna elements increases, decreasing communication performance. On the other hand, in the antenna unit 2 according to the present embodiment of the present invention, the respective main radiation directions of the three active antenna elements 31, 32, and 33 are different from each other, and accordingly, even when the three active antenna elements 31, 32, and 33 are disposed close to one another, it is less likely to cause degradation in communication performance, and it is effective in reducing size of the antenna unit 2.

Further, according to the present embodiment, it is possible to simplify the configuration of the antenna unit 2 by providing only two metal blocks 24 and 25 instead of three metal blocks 21, 22, and 23 of the first embodiment, and by configuring an antenna substrate 13 and the antenna substrate 14 made of two parallel printed wiring boards.

Figure 7:
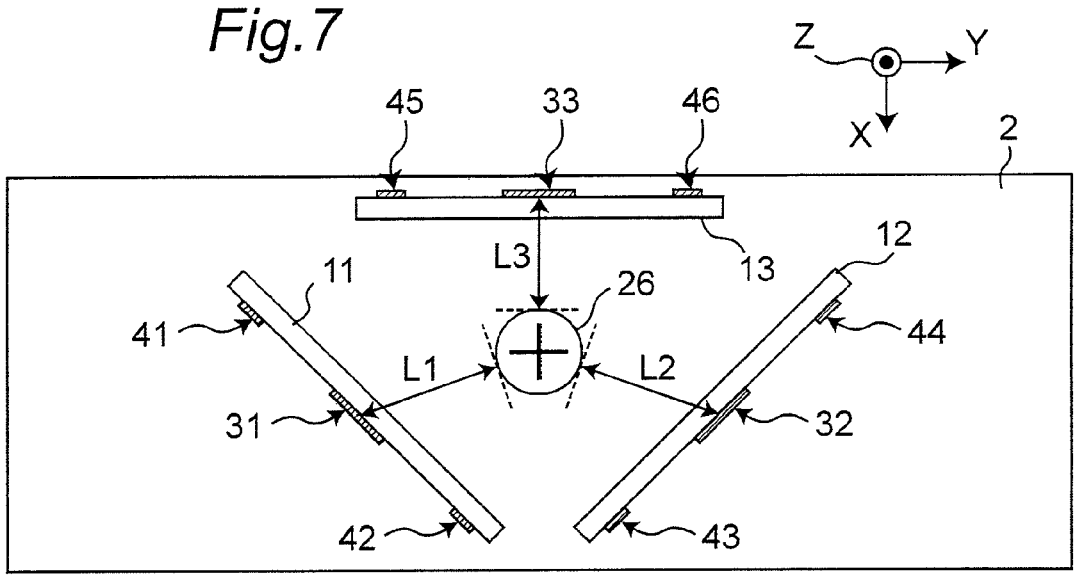
FIG. 7 is a top view showing an antenna unit 2 according to a first modified embodiment of the second embodiment of the present invention.

FIG. 7 is a top view showing an antenna unit 2 according to a first modified embodiment of the second embodiment of the present invention. According the embodiment of the present invention, the configuration is not limited to one in which two metal blocks 24 and 25 are provided for three active antenna elements 31, 32, and 33 as described with reference to FIGS. 5 and 6, and the configuration may be one in which one metal block is shared among a plurality of active antenna elements. The present modified embodiment is characterized in that only one metal block 26 is provided and the metal block 26 operates as a reflector for each of active antenna elements 31, 32, and 33. Antenna substrates 11, 12, and 13 respectively provided with the active antenna elements 31, 32, and 33 are disposed to surround the metal block 26. Also in the case of the present modified embodiment, the antenna unit 2 operates in a manner similar to those of the embodiments described with reference to FIGS. 1 to 6. The metal block 26 may be formed as a screw as in the case of FIGS. 5 and 6, thus fixing the antenna unit 2 to a housing of a wireless communication apparatus 1 through a dielectric block.

In addition, the configuration in the modified embodiment exemplified in the description of the first embodiment may be adopted in the second embodiment. For example, although an exemplary configuration of the present embodiment is provided with three active antenna elements 31, 32, and 33, five parasitic antenna elements 41, 44, 45, 46, and 47, and two metal blocks 24 and 25, the numbers of these components may be increased or decreased. Similarly, the number of antenna substrates may be increased or decreased.

Although it is desirable that the length of the metal blocks 24 and 25 be larger than the longitudinal length of the active antenna elements 31, 32, and 33 by 5 to 10%, any other configuration can be employed as long as the metal blocks 24 and 25 operate as reflectors. In addition, the metal blocks 24 and 25 may be prismatic, cylindrical, or planar, instead of screw-shaped.

Figure 11:
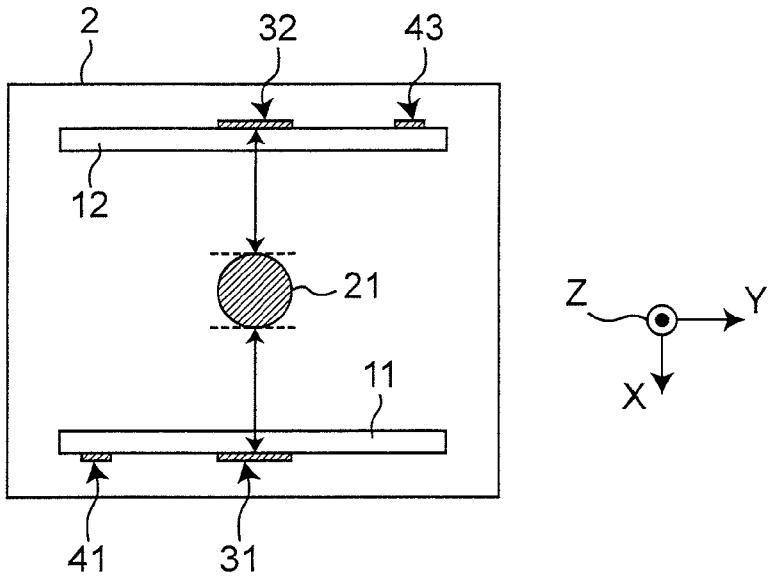
FIG. 11 is a top view showing an antenna unit 2 according to a second modified embodiment of the second embodiment of the present invention.

FIG. 11 is a top view showing an antenna unit 2 according to a second modified embodiment of the second embodiment of the present invention. The antenna unit 2 of the present modified embodiment has a minimum configuration according to an embodiment of the present invention. The antenna unit 2 of FIG. 11 is provided with two antenna substrates 11 and 12 and one metal block 21. Each antenna substrate includes only one active antenna element and one parasitic antenna element. A parasitic antenna element 41 and the metal block 21 are respectively disposed at positions remote from an active antenna element 31 by one-quarter of an operating wavelength for communication, and a parasitic antenna element 43 and the metal block 21 are respectively disposed at positions remote from an active antenna element 32 by one-quarter of the operating wavelength for communication. According to the antenna unit 2 of the present modified embodiment, even when metal components are scattered around the antenna unit 2 or in the antenna unit 2, it is possible to reduce their influence and properly change radiation patterns, in a manner similar to those of other antenna units 2 according to the first and second embodiments.

As described above, according to the antenna unit 2 of the present embodiment, the metal blocks 24 and 25 are disposed close to the active antenna elements 31, 32, and 33 configured to be steerable, and thus, even when a metal housing or metal components are located near or within the antenna unit in the wireless communication apparatus 1, it is possible to change radiation patterns without degrading the gain due to the influence of the metal housing or the metal components. In addition, the active antenna elements 31, 32, and 33 have the different main radiation directions due to the metal blocks 24 and 25. Accordingly, the correlations among the active antenna elements 31, 32, and 33 decreases, thus obtaining good performance in MIMO communication.

Third Embodiment

Figure 8:
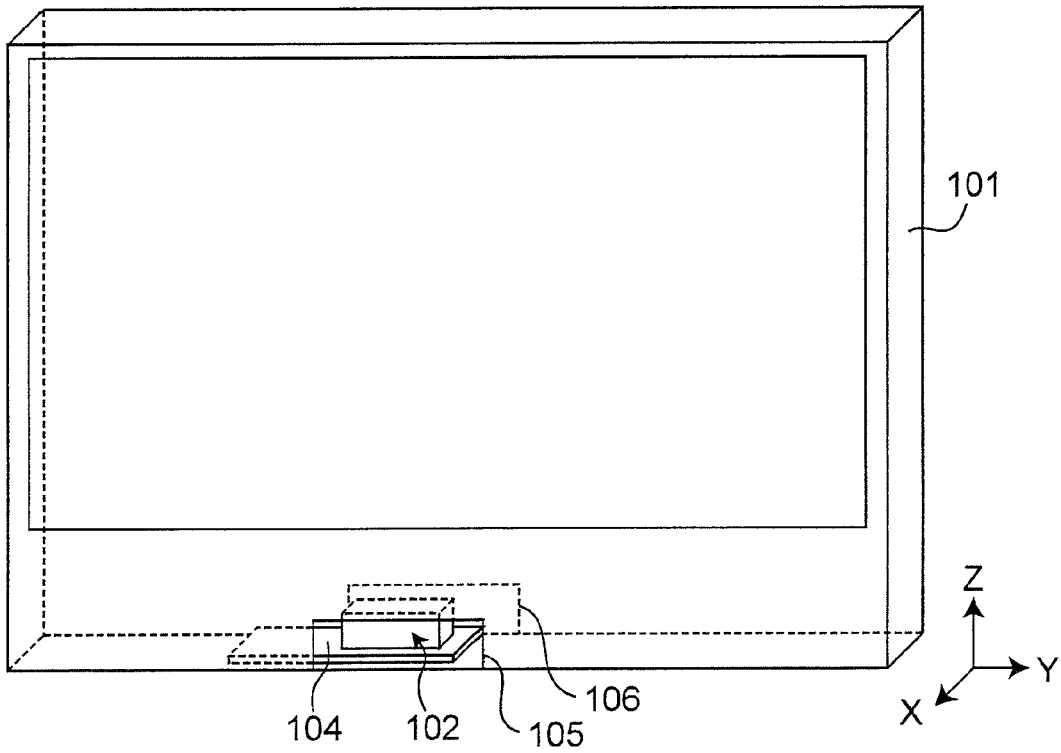
FIG. 8 is an overall view showing a wireless communication apparatus 101 provided with an antenna unit 102 according to a third embodiment of the present invention.
Figure 9:
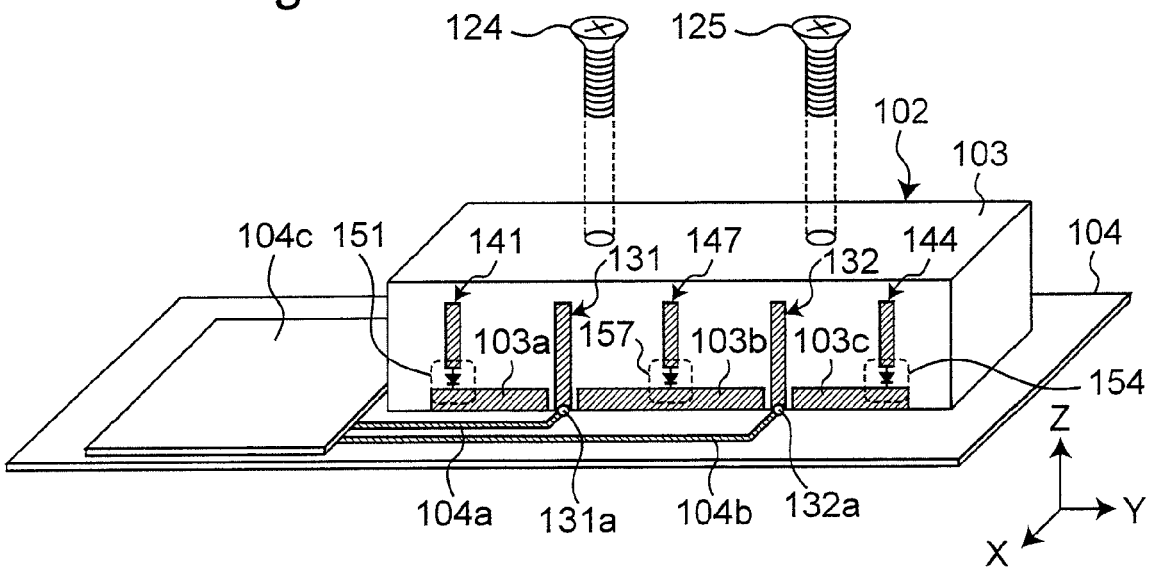
FIG. 9 is a perspective view showing a detailed configuration of the antenna unit 102 of FIG. 8.
Figure 10:
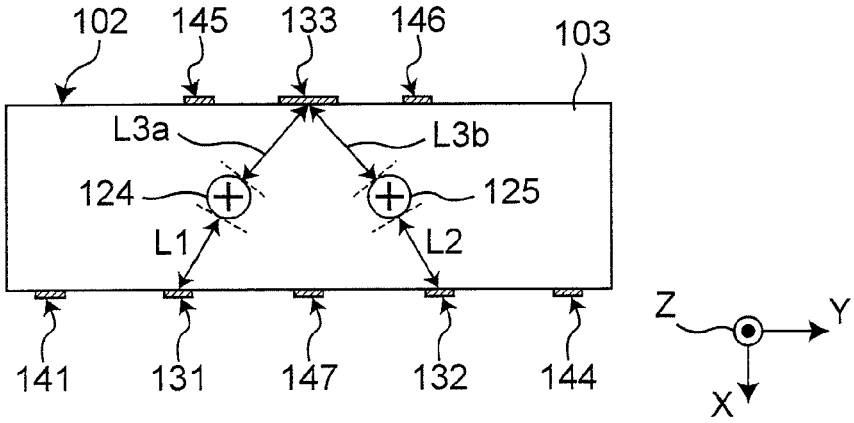
FIG. 10 is a top view showing a detailed configuration of the antenna unit 102 of FIG. 8.

FIG. 8 is an overall view showing a wireless communication apparatus 101 provided with an antenna unit according to a third embodiment of the present invention. FIG. 9 is a perspective view showing a detailed configuration of the antenna unit of FIG. 8. FIG. 10 is a top view showing a detailed configuration of the antenna unit of FIG. 8. According to embodiments of the present invention, the configuration is not limited to one in which active antenna elements and parasitic antenna elements are sleeve antennas and dipole antennas as in the first and second embodiments, and each of these antenna elements may be a monopole antenna as described below.

With reference to FIG. 8, an antenna unit 102 fixed on a printed wiring board 104 is provided within a metal housing of the wireless communication apparatus 101. In order to radiate radio waves in a +X direction and a −X direction from the position where the antenna unit 102 is mounted, the metal housing of the wireless communication apparatus 101 is partially cut away, and antenna windows 105 and 106 made of dielectric material such as a resin are provided. In the present embodiment, the antenna unit 102 is configured in a manner substantially similar to that of an antenna unit 2 of the second embodiment, except that active antenna elements and parasitic antenna elements are monopole antennas. Referring to FIGS. 9 and 10, the antenna unit 102 is provided with quarter-wave monopole active antenna elements 131 and 132 and quarter-wave monopole parasitic antenna elements 141, 144, and 147, each element patterned on a +X surface of a dielectric block 103 which is substantially rectangular parallelepiped, and further provided with a quarter-wave monopole active antenna element 133 and quarter-wave monopole parasitic antenna elements 145 and 146, each element patterned on a −X surface of the dielectric block 103. The active antenna elements 131, 132, and 133 have feeding points at positions in contact with the printed wiring board 104. As shown in FIG. 9, feeding points 131*a* and 132*a* of the active antenna elements 131 and 132 are connected to a wireless communication circuit 104*c* through radio frequency transmission lines 104*a* and 104*b* patterned on the printed wiring board 104, and thus radio frequency signals are transmitted and received. A feeding point of the active antenna element 133 is also connected to the wireless communication circuit 104*c* through a radio frequency transmission line (not shown). The parasitic antenna elements 141, 144, and 147 are respectively connected through switching circuits 151, 154, and 157, including PIN diodes, variable-capacitance diodes, or the like, to ground conductors 103*a*, 103*c*, and 103*b* patterned on the dielectric block 103. The parasitic antenna elements 145 and 146 are also similarly connected through switching circuits to ground conductors patterned on the dielectric block 103. The ground conductors patterned on the dielectric block 103 are connected to a ground plane (not shown) patterned on the printed wiring board 104. Accordingly, each of the active antenna elements and the parasitic antenna elements is located perpendicularly to the ground plane. Further, screw-shaped metal blocks 124 and 125 are disposed so as to pass through the dielectric block 103 from its +Z surface to its −Z surface. By using the metal blocks 124 and 125 as screws, the antenna unit 102 is fixed to the printed wiring board 104.

As shown in FIG. 10, the spaces among the active antenna elements 131, 132, and 133, the parasitic antenna elements 141, 144, 145, 146, and 147, and the metal blocks 124 and 125 are configured in a manner similar to that of FIG. 6. Accordingly, the antenna unit 102 of the present embodiment operates in a manner similar to that of the antenna unit 2 of the second embodiment.

In addition, the configuration in the modified embodiment exemplified in the description of the first embodiment may be adopted in the third embodiment. For example, although an exemplary configuration of the present embodiment is provided with three active antenna elements 131, 132, and 133, five parasitic antenna elements 141, 144, 145, 146, and 147, and two metal blocks 124 and 125, the numbers of these components may be increased or decreased. In addition, the dielectric block 103 does not need to be a rectangular parallelepiped, and may be, for example, other polyhedron or cylinder. Although in the present embodiment the height of the metal blocks 124 and 125 is about one-quarter of an operating wavelength for communication and is preferably larger than the longitudinal length of the active antenna elements 131, 132, and 133 by 5 to 10%, any other configuration can be employed as long as the metal blocks 124 and 125 operate as reflectors. In addition, the metal blocks 124 and 125 may be prismatic, cylindrical, or planer, instead of screw-shaped, as long as the metal blocks 124 and 125 are made of metal.

As described above, according to the antenna unit 102 of the present embodiment, the metal blocks 124 and 125 are disposed close to the active antenna elements 131, 132, and 133 configured to be steerable, and thus, even when a metal housing or metal components are located near or within the antenna unit in the wireless communication apparatus 101, it is possible to change radiation patterns without degrading the gain due to the influence of the metal housing or the metal components. In addition, the active antenna elements 131, 132, and 133 have the different main radiation directions due to the metal blocks 124 and 125. Accordingly, the correlations among the active antenna elements 131, 132, and 133 decreases, thus obtaining good performance in MIMO communication.

Industrial Applicability

According to the array antenna apparatus of the present invention, it is possible to properly change radiation patterns even under presence of a closely located metal housing or metal components, and accordingly, it is useful for providing steerable antennas within an electronic appliance capable of wireless communication.

Reference Signs List

1, 101: wireless communication apparatus,
2, 102: antenna unit,
3, 103: dielectric block,
11, 12, 13, 14: antenna substrate,
21, 22, 23, 24, 25, 26, 124, 125: metal block,
31, 32, 33, 131, 132: active antenna element,
31*a*, 32*a*, 33*a*, 131*a*, 132*a*: feeding point,
41, 42, 43, 44, 45, 46, 47, 141, 144, 147: parasitic antenna element,
41*a*, 41*b*: parasitic conductor element,
41*c*: conductor portion,
51, 52, 53, 54, 55, 56, 57, 151, 154, 157: switch circuit,
51*a*, 51*b*, 51*c*: control line,
51D1, 51D2: PIN diode,
51L1, 51L2, 51L3: inductor,
51R: resistor,
103*a*, 103*b*, 103*c*: ground conductor,
104: printed wiring board,
104*a*, 104*b*: radio frequency transmission line,
104*c*: wireless communication circuit,
105, 106: antenna window,
200: MIMO modulation and demodulation circuit,
201: input and output terminal,
202: controller, and
300: metal components etc.

The invention claimed is:

1. An array antenna apparatus comprising:

a plurality of steerable antennas, each having one active antenna element and at least one parasitic antenna element; and at least one metal block with a length longer than a longitudinal length of each of the active antenna elements, wherein at least two of the steerable antennas are simultaneously excited, wherein each of the active antenna elements is associated with at least one of the at least one metal block such that the at least one metal block associated with a corresponding active antenna element is disposed remote from the corresponding active antenna element by a predetermined distance and operates as a reflector for the corresponding active antenna element, and wherein each of the parasitic antenna elements is provided with a switching circuit for changing an electrical length of the parasitic antenna element, and the parasitic antenna element operates as a reflector for an active antenna element of the same steerable antenna as the parasitic antenna element by changing the electrical length using the switching circuit.

2. The array antenna apparatus as claimed in claim 1, wherein the array antenna apparatus comprises one metal block, and the one metal block is disposed remote from each of the active antenna elements by a predetermined distance and operates as a reflector for each of the active antenna elements.

3. The array antenna apparatus as claimed in claim 1, wherein the plurality of steerable antennas are provided on two opposite surfaces of a dielectric block, and each metal block is provided so as to pass through the dielectric block.

4. The array antenna apparatus as claimed in claim 1, wherein each of the parasitic antenna elements is a half-wave dipole antenna, and each of the switching circuits is a PIN diode connected in series at a center of a corresponding parasitic antenna element.

5. The array antenna apparatus as claimed in claim 1, wherein each of the parasitic antenna elements is a half-wave dipole antenna, and each of the switching circuits is a variable-capacitance diode connected in series at a center of a corresponding parasitic antenna element.

6. The array antenna apparatus as claimed in claim 1, wherein each of the active antenna elements and the parasitic antenna elements is formed as a conductor patterned on a dielectric substrate.

7. The array antenna apparatus as claimed in claim 1, wherein each of the active antenna elements and the parasitic antenna elements is a monopole element which is a conductor element with a length of one-quarter wavelength and perpendicular to a ground conductor, and each of the switching circuits is a PIN diode connected between a conductor element of a corresponding parasitic antenna element and the ground conductor.

8. The array antenna apparatus as claimed in claim 1, wherein each of the active antenna elements and the parasitic antenna elements is a monopole element which is a conductor element with a length of one-quarter wavelength and perpendicular to a ground conductor, and each of the switching circuits is a variable-capacitance diode connected between a conductor element of a corresponding parasitic antenna element and the ground conductor.

9. The array antenna apparatus as claimed in claim 1, wherein each of the active antenna elements is a dipole antenna.

10. The array antenna apparatus as claimed in claim 1, wherein each of the active antenna elements is a sleeve antenna.

11. The array antenna apparatus as claimed in claim 1, wherein the array antenna apparatus transmits and receives a plurality of radio signals in accordance with a MIMO communication scheme.

12. An array antenna apparatus comprising:

a plurality of steerable antennas, each having one active antenna element and at least one parasitic antenna element; and a plurality of metal blocks each having a length longer than a longitudinal length of each of the active antenna elements, wherein at least two of the steerable antennas are simultaneously excited, wherein each of the active antenna elements is associated with one of the plurality of metal blocks such that the metal block associated with a corresponding active antenna element is disposed remote from the corresponding active antenna element by a predetermined distance and operates as a reflector for the corresponding active antenna element, and wherein each of the parasitic antenna elements is provided with a switching circuit for changing an electrical length of the parasitic antenna element, and the parasitic antenna element operates as a reflector for an active antenna element of the same steerable antenna as the parasitic antenna element by changing the electrical length using the switching circuit.

* * * * *